US006018822A

United States Patent [19]

Hernandez

[11] Patent Number: 6,018,822

[45] Date of Patent: Feb. 1, 2000

[54] DUAL VENT SHORTS

[76] Inventor: Maximillian Hernandez, 1090 High Country Rd., Baltimore, Md. 21286

[21] Appl. No.: 09/222,473

[22] Filed: Dec. 29, 1998

Related U.S. Application Data

[63] Continuation-in-part of application No. 29/080,295, Dec. 1, 1997.

[51] Int. Cl.[7] ..... A41B 9/00; A41B 9/02; A41B 9/04; A41D 1/06

[52] U.S. Cl. ..... 2/405; 2/78.2

[58] Field of Search ..... 2/405, 78.1, 78.2, 2/400, 402, 403, 404, 408, 228, 234, 238

[56] References Cited

U.S. PATENT DOCUMENTS

| | | | |
|---|---|---|---|
| D. 378,947 | 4/1997 | Desmond | D2/738 |
| 1,283,006 | 10/1918 | Willcox . | |
| 1,426,525 | 8/1922 | Walsh . | |
| 2,335,658 | 11/1943 | Fishbein . | |
| 2,438,310 | 3/1948 | Ashe et al. . | |
| 2,624,336 | 1/1953 | Hansley . | |
| 3,020,556 | 2/1962 | Isley . | |
| 3,844,282 | 10/1974 | King | 602/67 |
| 4,377,008 | 3/1983 | Jung | 2/403 |
| 4,446,575 | 5/1984 | Davis | 2/400 |
| 4,930,161 | 6/1990 | Cohen | 2/114 |
| 4,944,733 | 7/1990 | Casale | 604/385.1 |
| 5,029,345 | 7/1991 | Angheluta et al. | 2/403 |
| 5,210,882 | 5/1993 | Moretz et al. | 2/404 |
| 5,379,462 | 1/1995 | Morgan et al. . | |
| 5,598,586 | 2/1997 | Munjone | 2/237 |

*Primary Examiner*—John J. Calvert
*Assistant Examiner*—Shirra L. Jenkins

[57] ABSTRACT

An article of clothing of shorts or pants type, having a pair of front panels, overlying a vent backing panel. The joined central sides of front panels having unjoined portions defining dual vents. The dual vents provide access to the penis through two separate pathways. The dual vent shorts while providing easy access for right-handed individuals as well as left-handed individuals also provide a secure housing to contain the penis during the normal course of activity. The unique design also provides a vent backing panel to serve as a moisture barrier to prevent moisture from soiling the outer garment. Embodiments include applications for boxer shorts, boxer-briefs, and briefs. Fabric for the shorts include woven, knit, and a combination of both woven and knit components.

17 Claims, 6 Drawing Sheets

DUAL VENT SHORTS

CROSS-REFERENCE TO RELATED APPLICATIONS

This is a continuation-in-part of application Ser. No. 29/080,295, filed Dec. 1, 1997.

BACKGROUND—FIELD OF INVENTION

This invention relates to an article of clothing of short type, specifically to an improved vent design for shorts.

BACKGROUND—DESCRIPTION OF PRIOR ART

Shorts used as the initial covering over the naked male torso are created exclusively with one centrally located vent for access to the penis for the purpose of urination. This single centrally located vent does not create a secure housing to contain the penis during the normal course of activity. The vent tends to gap exposing the penis.

Additionally, a centrally located vent does not provide easy access to the penis for all individuals. This vent design would most benefit right-handed individuals by opening from right to left. The U.S. Pat. No. 3,844,282 to King (1974) discloses a knit boxer short. The King reference does not provide a secure housing to contain the penis within the layers of the garment. The penis will still fall through the internal layer during the normal course of activity, creating discomfort for the wearer. This design is also hampered by the lack of access for all individuals, since the external vent access will either be from the right or the left.

The U.S. Pat. No. 5,210,882 to Moretz (1993) discloses an undergarment having an off-center vent composed of overlapping panels. The off center does not provide ease of access to the penis. The off-center vent will favor the right-handed or left-handed individual depending on the positioning of the off-center vent.

OBJECTS AND ADVANTAGES

It is the object or advantage of the dual vent shorts to provide a secure housing to contain the penis during the normal course of activity. The dual vent shorts provide a wide vent backing panel to contain the penis. This overcomes the shortcomings of the King patent, which provides an internal centrally located vent in front of the penis. This centrally located vent would cause the penis to fall through the internal layer during the normal course of activity creating discomfort for the wearer.

The dual vent shorts' unique design overcomes the shortcoming of the King patent which gaps and exposes the penis. The dual vent shorts posses a vent backing panel underlying a pair of front side panels. This layering of the vent backing panel coupled with the pair of front side panels provides a secure and comfortable housing for the penis.

Additionally, another object or advantage of the dual vent shorts is to provide easy access for all wearers. The dual vent shorts overcome the inadequacies of the King reference which provides an off center vent. An off-center vent does not provide easy access for all individuals to the penis. This vent design commonly used in the marketplace benefits right-handed individuals opening from the right to the left. The dual vent shorts provide access to the penis through two separate pathways. The dual vent shorts provide easy access for right-handed individuals as well as left-handed individuals, a design that will benefit all individuals.

A further object or advantage of the dual vent shorts is to provide a moisture barrier between the penis and the outer garment. The dual vent shorts, through its overlapping panels and secure housing, provide this barrier.

Further objects and advantages of the dual vent shorts will become apparent from a consideration of the drawings and the ensuing description.

DRAWING FIGURES

REFERENCE NUMERALS IN DRAWINGS

Figure 1:
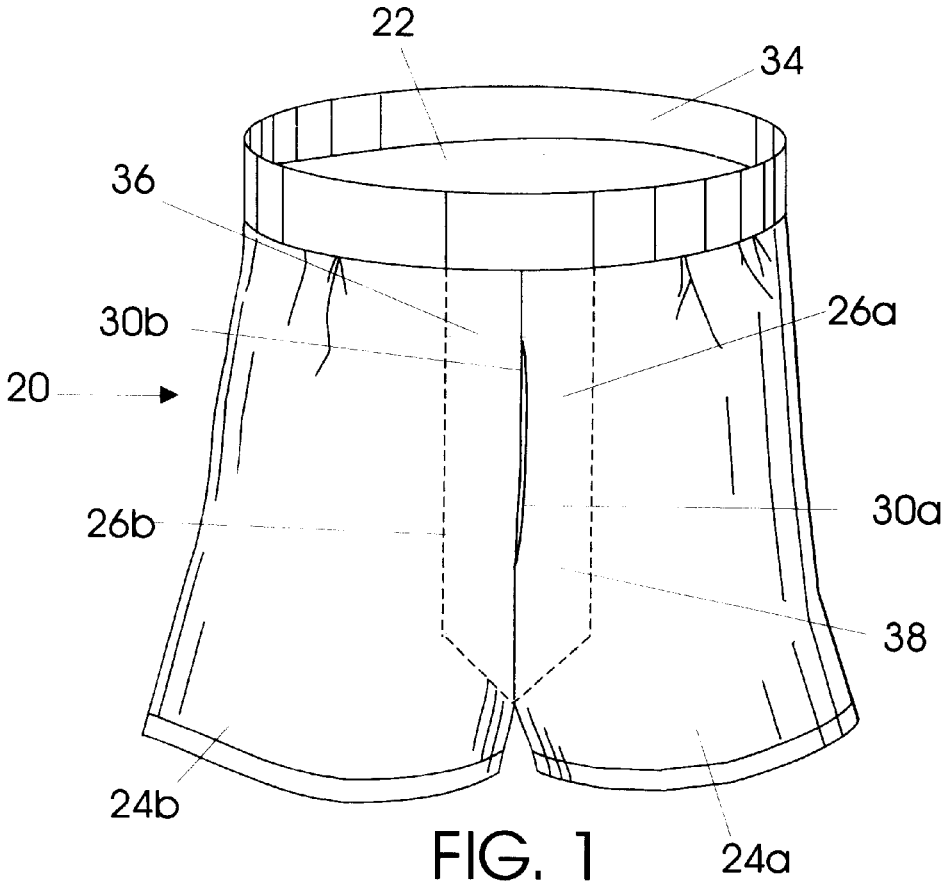
FIG. 1 is a front view
Figure 2:
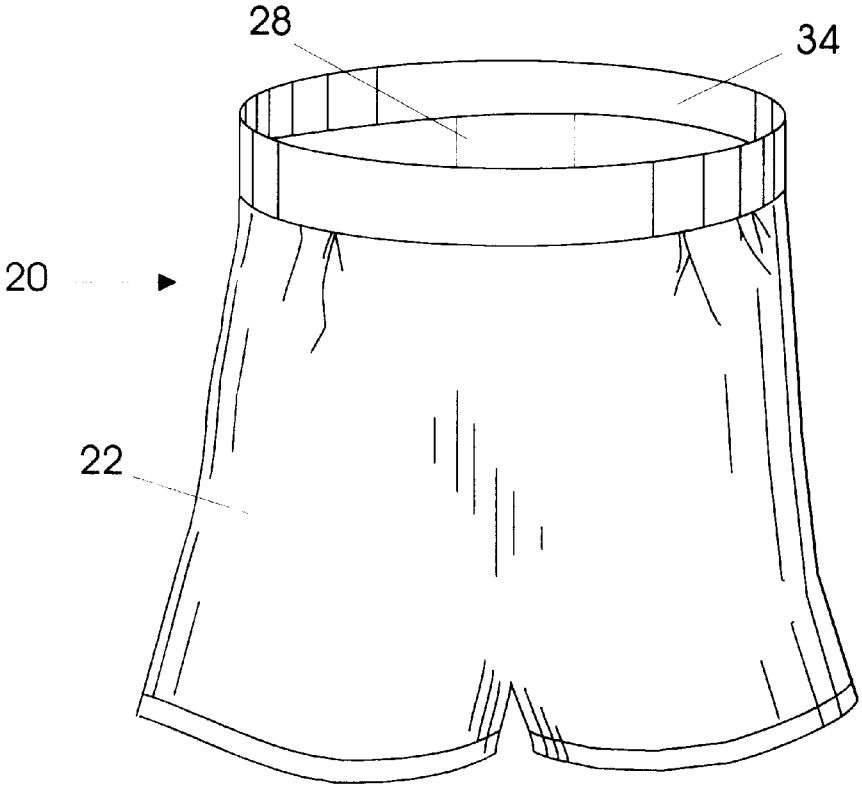
FIG. 2 is a back view
Figure 3:
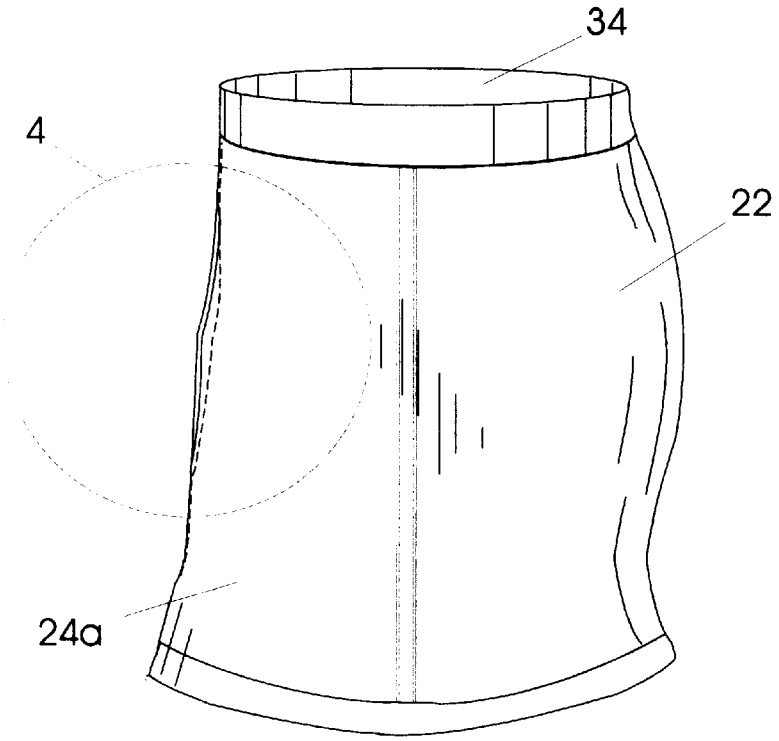
FIG. 3 is a side view
Figure 4:
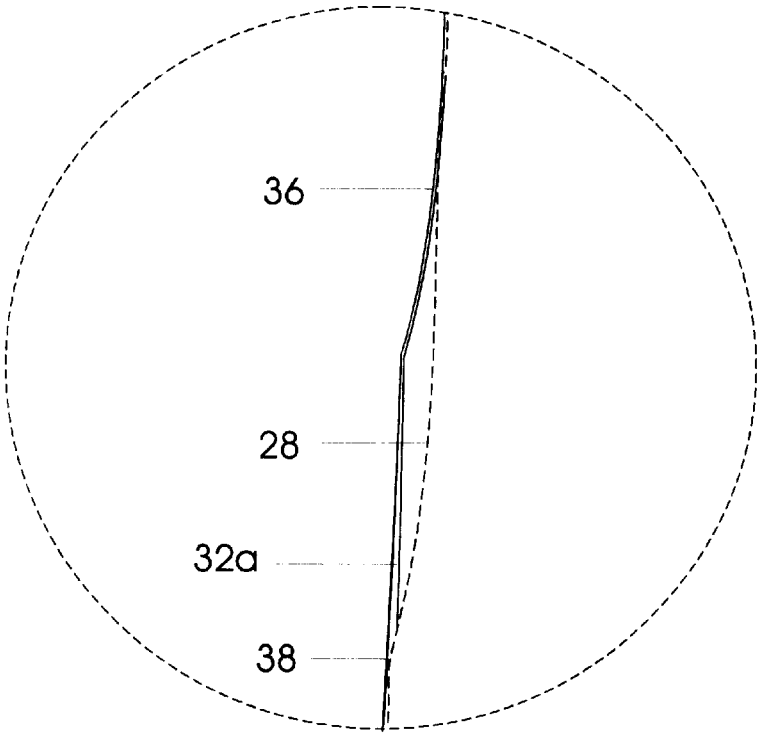
FIG. 4 is a side enhanced view

| | |
|---|---|
| 20 short | 22 rear panel |
| 24a right front panel | 24b left front panel |
| 26a right front fold | 26b left front fold |
| 28 vent backing panel | 30b left external vent |
| 30a right external vent | 36 vent top seam |
| 32a right internal vent | 40b left front panel front top edge |
| 34 waistband | 42b left front panel notch |
| 38 vent bottom seam | 44b left front panel front bottom edge |
| 40a right front panel front top edge | 46b left front panel back edge |
| 42a right front panel notch | 48b rear panel left edge |
| 44a right front panel front bottom edge | |
| 46a right front panel back edge | |
| 48a rear panel right edge | |

SUMMARY

Therefore it is in an object of the invention to provide an article of clothing that provides access to the penis through two separate pathways. The dual vent shorts also provide a secure housing to contain the penis during the normal course of activity as well as a vent backing panel to serve as a barrier to prevent moisture from soiling the outer garment.

DESCRIPTION

This application claims the benefit of U.S. application Ser. No. 29/080,295, filed Dec. 1, 1997.

Referring to the drawings, shorts embodied by this invention are generally indicated by the numeral 20. The dual vent short 20 includes a rear panel 22, a left front panel 24*a*, a right front panel 24*b*, a waistband 34, and a vent backing panel 28.

Figure 5:
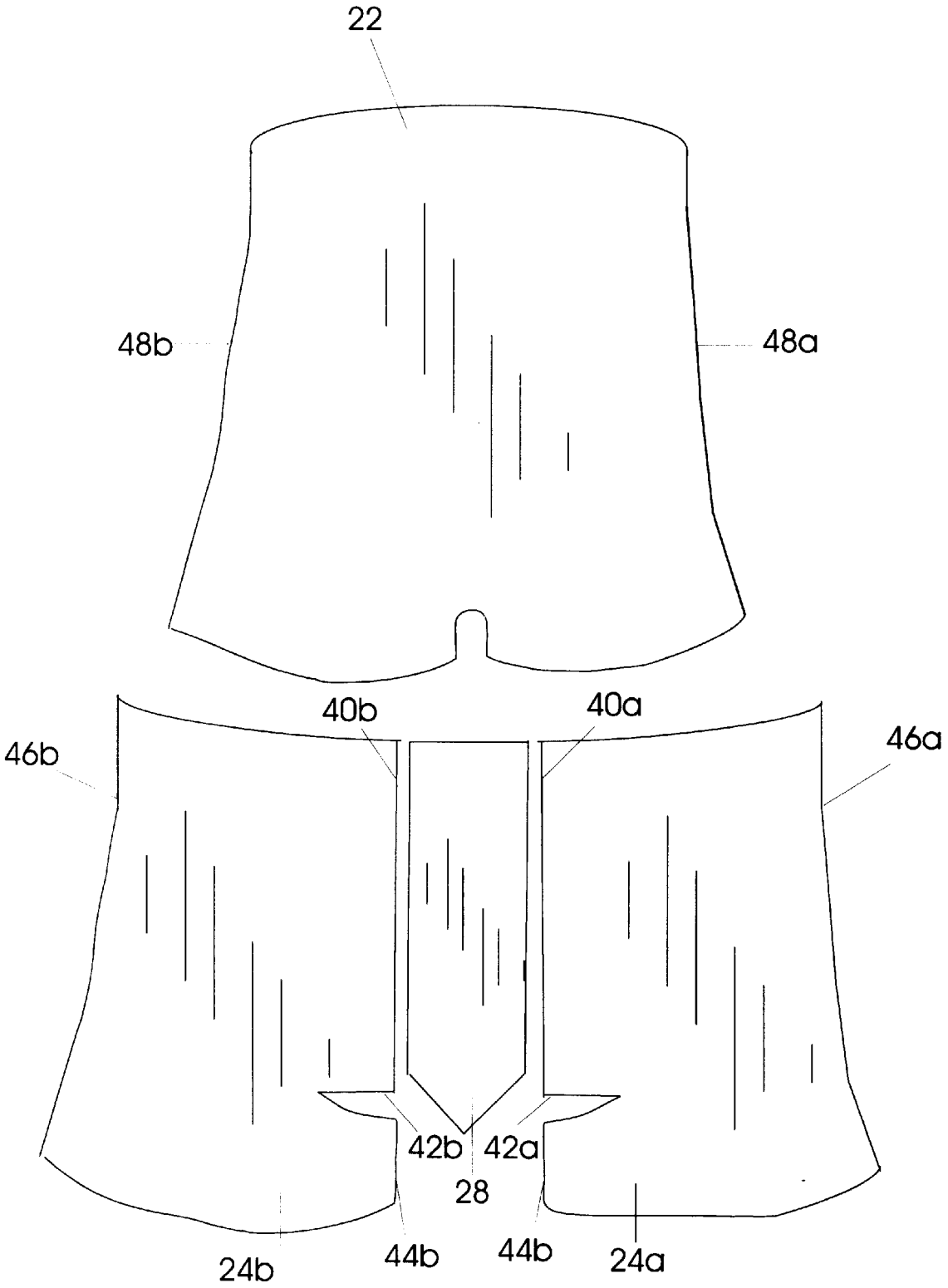
FIG. 5 is a view illustrating the configuration of the fabric pieces that comprise the short shown in FIG. 1.
Figure 6:
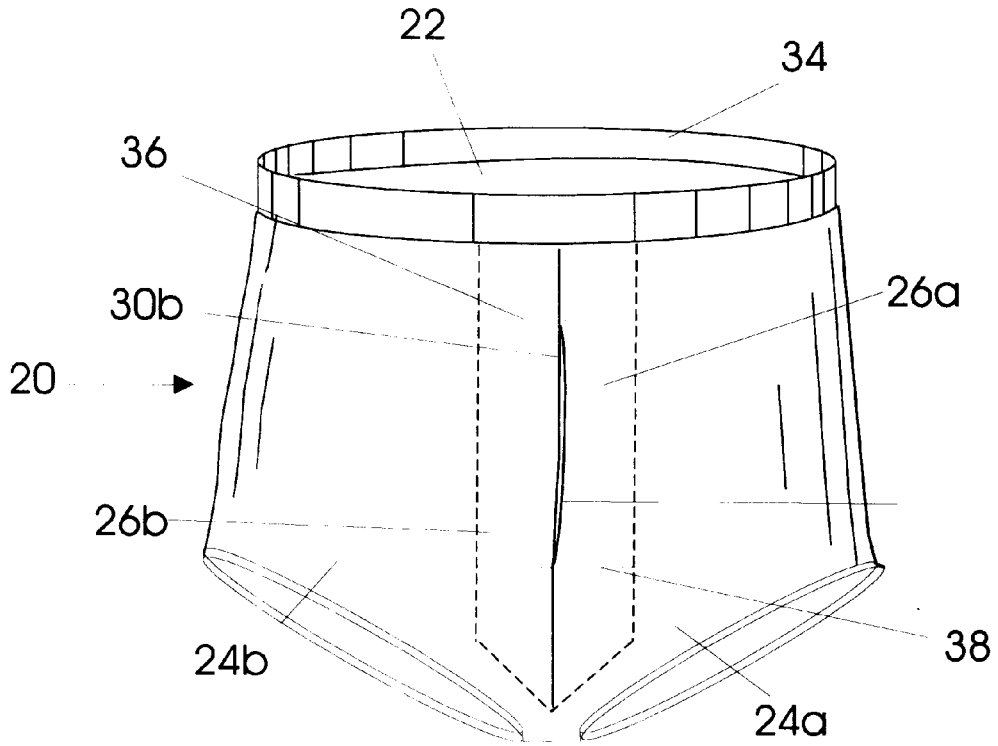
FIG. 6 is a front view of second embodiment.
Figure 7:
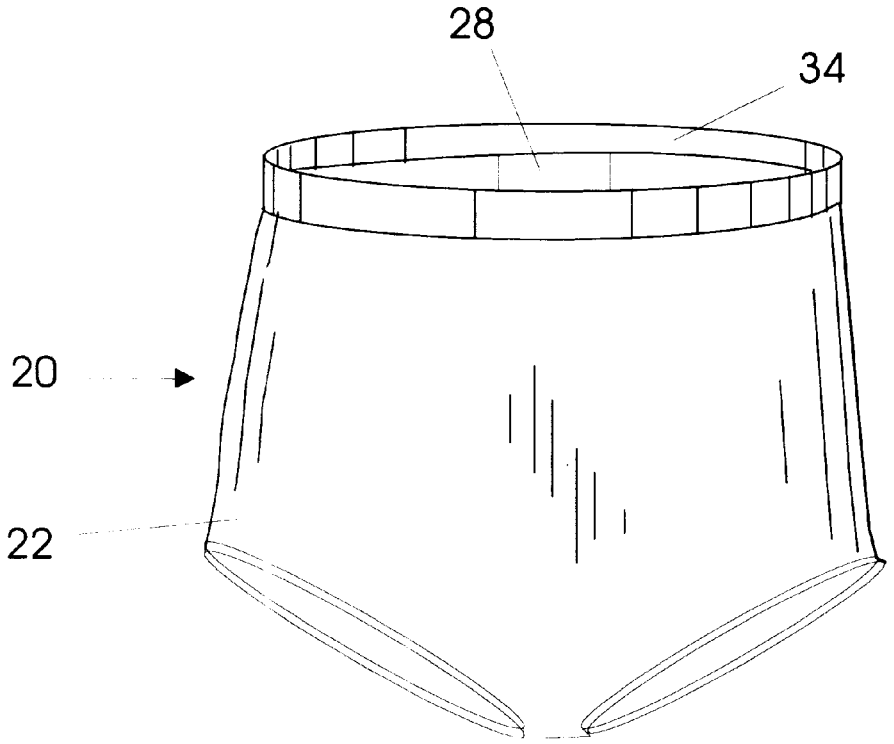
FIG. 7 is a back view of second embodiment.
Figure 8:
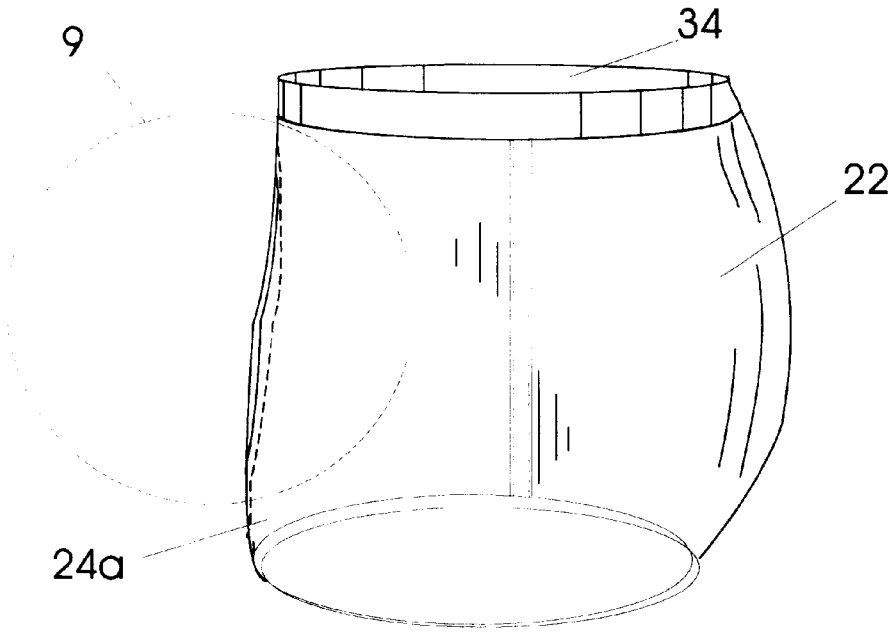
FIG. 8 is a side view of second embodiment.
Figure 9:
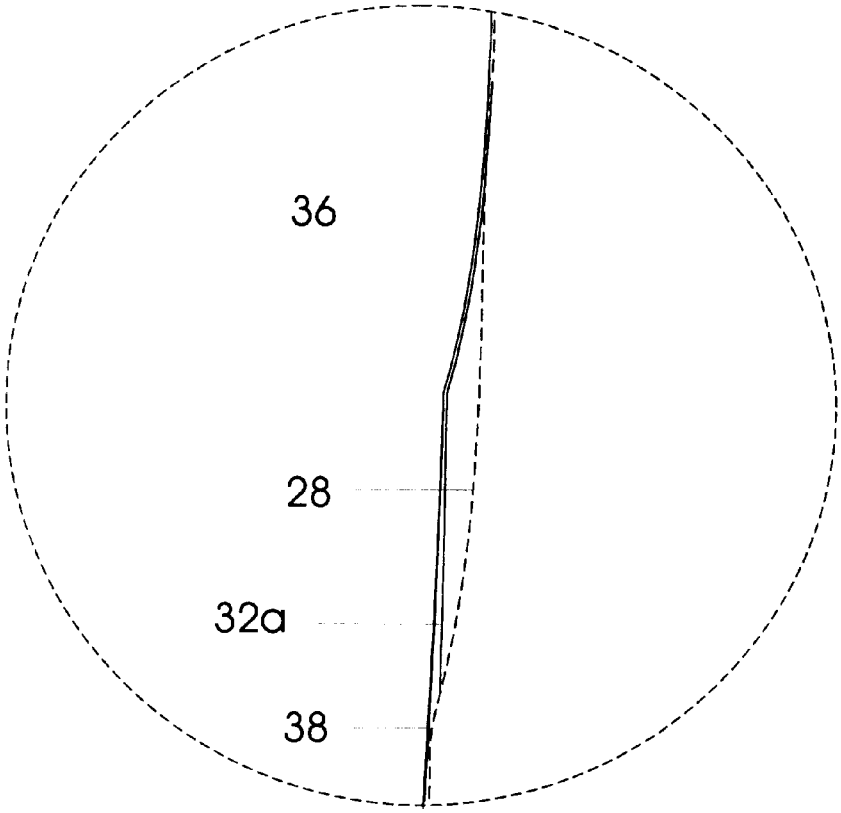
FIG. 9 is a side enhanced view of second embodiment.
Figure 10:
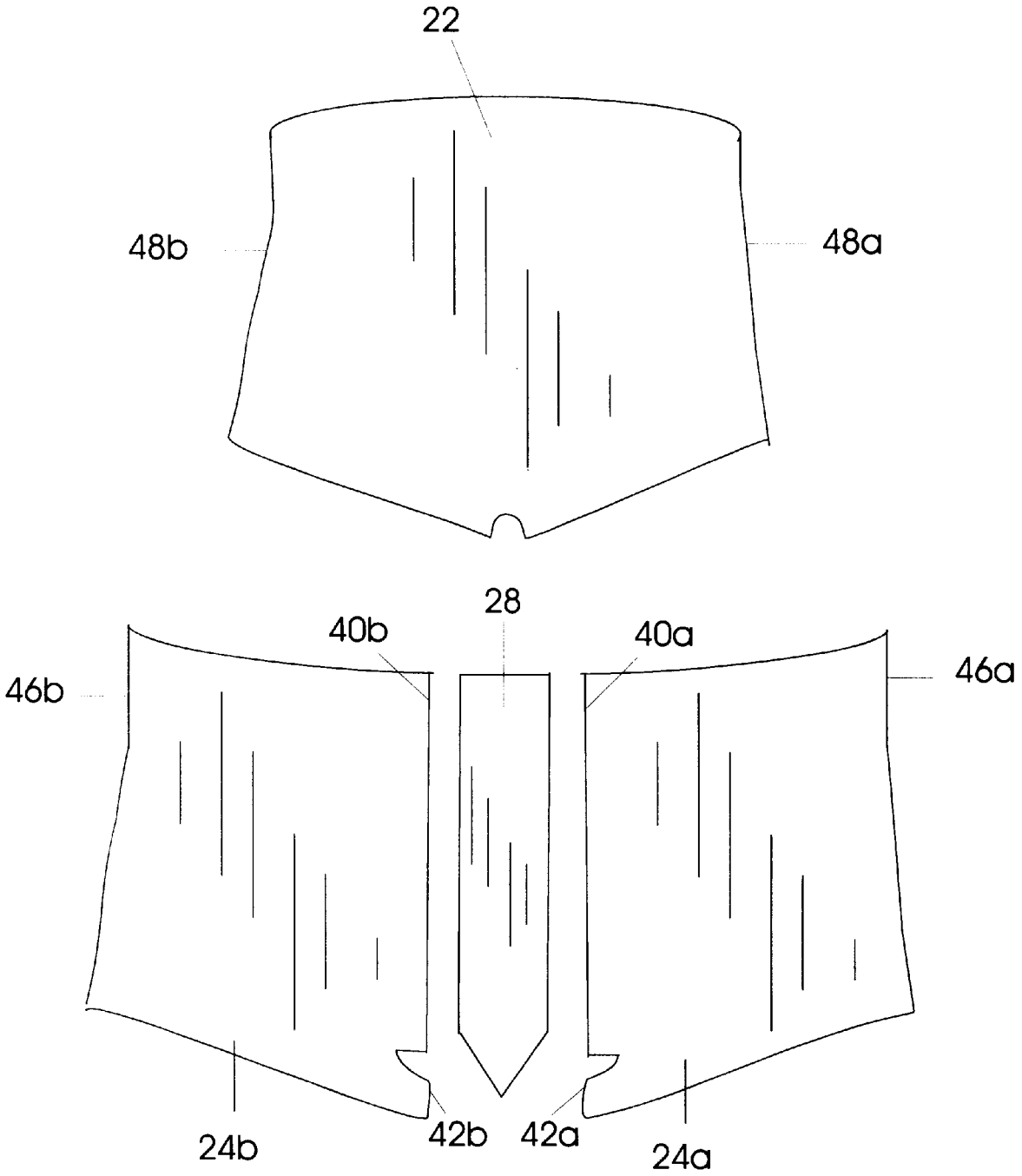
FIG. 10 is a view illustrating the configuration of the fabric pieces that comprise the short shown in FIG. 6.

The patterns of the components of fabric comprising the dual vent short are illustrated in both FIG. 5 and FIG. 10. The pieces comprising the dual vent shorts 20 include front panels 24*a* and 24*b*, the rear panel 22, and the vent backing panel 28. The front panels 24*a* and 24*b* are mirror images of one another. The front panels 24*a* and 24*b* possess a left front panel front top edge 40*a* and a right front top edge 40*b*. Below top edges 40*a* and 40*b* are a left front panel notch 42*a* and a right front panel notch 42*b*.

Top edges 40*a* and 40*b* are folded above notches 42*a* and 42*b* to form both a left front fold 26*a* and a right front fold 26*b*. Front folds 26*a* and 26*b* are placed laterally at edge Front panels 24*a* and 24*b* are joined along an exterior side thereof at 46*a* and 46*b* to rear panel exterior sides 48*a* and 48*b*. Front panels 24*a* and 24*b* are joined along the central side thereof to vent backing panel 28, the joined central sides of front panels 24*a* and 24*b* having unjoined portions defining dual external vent openings at 30*a* and 30*b* and dual internal vents such as at 32*a*. The external vents 30*a* and 30*b* and the internal vents such as at 32*a* are bordered at the top by a vent top seam 36 and at the bottom by a bottom seam 38.

The top of the shorts 20 are created by attaching the waistband 34 to the top portions all the fabric including front panels 24*a* and 24*b*, the rear panel 22, and the vent backing panel 28. The bottom crotch section is created by laterally attaching the lower front panel sides 44*a* and 44*b*. The bottom sides of the attached vent backing panels 24*a* and 24*b* are then attached to the bottom side of the rear panel 22.

FIGS. 1–5 represent a boxer short or a boxer brief embodiment. FIGS. 6–10 represent a brief embodiment.

Operation

The dual vent shorts 20 provide easy access for all individuals to the penis for the purpose of urination.

The front panels 24*a* and 24*b* are joined along the central side thereof to vent backing panel 28, the joined central sides of front panels 24*a* and 24*b* having unjoined portions defining dual external vents at 30*a* and 30*b* and dual internal vents. The external vents 30*a* and 30*b* and the internal vents are bordered at the top by a vent top seam 36 and at the bottom by a bottom seam 38.

Access to the penis is provided through two separate pathways. The wearer could access though external vent 30*a* and then through internal vent 32*a* or through external vent 30*b* and then through a second internal vent. Dual vent shorts 20 provide easy access from both the right and left direction.

After the wearer is done urinating, the penis could be returned inside the garment through the aforementioned pathways. The vent backing panel 28 will serve to capture any extraneous moisture upon the return of the penis to the inside of the garment.

The shorts 20 would have a similar function whether the dual vent shorts were of a boxer short type, brief type, or of a boxer brief type. The shorts 20 would also have a similar function whether constructed from a woven, knit, or a combination of both woven and knit components.

Still further objects and advantages of the dual vent shorts will become apparent from a consideration of the drawings and the ensuing description.

Conclusions, Ramifications, and Scope

Dual vent shorts provide a secure housing to contain the penis during the normal course of activities while providing easy access for right-handed individuals as well as left-handed individuals. The unique design also provides a vent backing panel to serve as a barrier to prevent moisture from soiling the outer garment.

While the above description contains many specificities, these should not be construed as limitations on the scope of the invention, but rather as an exemplification of one preferred embodiment thereof. Many other variations are possible. For example applications exist for sleepwear as well as swimwear, among other applications. Accordingly, the scope of the invention should be determined not by the embodiment(s) illustrated, but by the appended claims and their legal equivalents.

I claim:

1. An article of clothing having a pair of front panels, a rear panel, a vent backing panel and a means for providing dual unencumbered access through said front panels, said rear panel being a solid panel with no openings, said front panels overlying said vent backing panel wherein said vent backing panel is joined to said front panels along vertical edges and wherein said means for providing dual unencumbered access is located between said vertical edges and said front panels.

2. The article of clothing of claim 1 wherein the front panels and the vent backing panel are composed of woven fabric.

3. The article of clothing of claim 1 where the front panels and the vent backing panels are composed of knit fabric.

4. The article of clothing of claim 1 where the front panels are composed of knit fabric and the vent backing panel is composed of woven fabric.

5. The article of clothing of claim 1 where the front panels are composed of woven fabric and the vent backing panels is composed of knit fabric.

6. The article of clothing of claim 1 having an embodiment where the front panels extend down the upper leg of the wearer characteristic of a boxer short type short.

7. The article of clothing of claim 1 having an embodiment where the front panels extend to the start of the leg of the wearer characteristic of a brief type short.

8. The article of clothing of claim 1 having an opening provided by the space between the pair of front panels.

9. The article of clothing of claim 1 where the vent backing panel underlies the front panels.

10. An article of clothing comprising:

a rear panel of solid fabric, a pair of front panel of fabric being joined along an exterior side thereof to said rear panel and being joined along a central side thereof to a vent backing panel, the joined central sides of said front panels having unjoined portions defining an external vent opening, said vent backing panel being joined to said front panels along vertical edges thereof and underlying the external vent opening in said front panels, both vertical sides of said vent back panel being unjoined along a portion thereby defining dual internal vent openings.

11. The article of clothing of claim 10 wherein the front panels, the rear panel, and the vent backing panel are composed of woven fabric.

12. The article of clothing of claim 10 where the front panels, the rear panel, and the vent backing panels are composed of knit fabric.

13. The article of clothing of claim 10 where the front panels and the rear panel are composed of knit fabric and the vent backing panel is composed of woven fabric.

14. The article of clothing of claim 10 where the front panels and the rear panel are composed of woven fabric and the vent backing panels is composed of knit fabric.

15. The article of clothing of claim 10 having an embodiment where the front panels and the rear panel extend down the upper leg of the wearer characteristic of a boxer short type short.

16. The article of clothing of claim 10 having an embodiment where the front panels and the rear panel extend to the start of the leg of the wearer characteristic of a brief type short.

17. The article of clothing of claim 10 where the vent backing panel underlies the front panels.

* * * * *